US007434882B1

(12) United States Patent
Hodges

(10) Patent No.: US 7,434,882 B1
(45) Date of Patent: Oct. 14, 2008

(54) COMBINATION ERGONOMIC CHAIR AND SEAT PIVOTING MECHANISM

(76) Inventor: George A. Hodges, 7729 Bermago Rd., Fortqorth, TX (US) 76112

( * ) Notice: Subject to any disclaimer, the term of this patent is extended or adjusted under 35 U.S.C. 154(b) by 153 days.

(21) Appl. No.: 11/604,040

(22) Filed: Nov. 24, 2006

Related U.S. Application Data

(60) Provisional application No. 60/739,770, filed on Nov. 28, 2005.

(51) Int. Cl.
*A47C 1/00* (2006.01)

(52) U.S. Cl. ..... 297/335; 297/339; 297/DIG. 10

(58) Field of Classification Search ..... 297/217.1, 297/313, 330, 335, 337, 339, DIG. 10
See application file for complete search history.

(56) References Cited

U.S. PATENT DOCUMENTS 1,379,943 A * 5/1921 Stevens ..... 297/339
2,517,048 A * 8/1950 Stacy et al. ..... 297/217.1
3,623,767 A * 11/1971 Condon ..... 297/330
4,907,303 A 3/1990 Baird
4,929,022 A * 5/1990 Geraci ..... 297/313
5,011,224 A * 4/1991 Paul ..... 297/339
5,082,327 A 1/1992 Crisp
5,445,431 A * 8/1995 Johnston ..... 297/339
5,490,687 A * 2/1996 Scholl ..... 297/DIG. 10
5,513,867 A * 5/1996 Bloswick et al. ..... 297/DIG. 10
5,626,389 A * 5/1997 Logan, Jr. ..... 297/250.1
6,113,188 A 9/2000 Stewart et al.
2006/0260621 A1 * 11/2006 Agrawal et al. ..... 128/845

* cited by examiner

*Primary Examiner*—Peter R. Brown

(57) ABSTRACT

A combination chair and seat pivoting mechanism includes a frame and a seat section pivotally connected to a front end of the frame. The seat section is pivotal along a fulcrum axis defined along a front end thereof. The front end remains contiguously abutted with the frame during pivoting motions. Pulleys are connected to spaced portions of the frame and are registered along a single plane. A weight member is coupled to the pulleys and positioned subjacent to the seat section. A cable is tethered to the frame and the weight member. A pneumatic piston has a stationary portion coupled to the frame, and a linear piston coupled to the seat section. The pneumatic piston and weight member cooperate in tandem for resisting an operating force directed on the seat section during sitting and standing procedures.

18 Claims, 8 Drawing Sheets

COMBINATION ERGONOMIC CHAIR AND SEAT PIVOTING MECHANISM

CROSS REFERENCE TO RELATED APPLICATIONS

This application claims the benefit of U.S. Provisional Application No. 60/739,770, filed Nov. 28, 2005.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to chairs and, more particularly, to a combination ergonomic chair and seat pivoting mechanism for assisting a user to transfer their body mass between sitting and standing positions.

2. Prior Art

Persons recovering from surgery, suffering from arthritis, or otherwise partially incapacitated are often incapable of lifting themselves from a sitting position without the assistance of another person. Persons with muscle weakness or other conditions also find it difficult to lower themselves carefully and safely to a sitting position. One of the solutions proposed for enabling these persons to rise out of a chair without the assistance of another is to provide a chair to lift the occupant with the seat to at least a partially standing position, or provide a seat to meet a user backside before a user has reached a fully sitting position.

One prior art example shows an assist chair that includes a frame for pivotally mounting a seat. A pair of springs attached to the seat bias the seat upwardly to assist the user to a standing position. A movable attachment point for an end of the springs distal from the seat attachment point allows the upward biasing force applied to the seat to be varied from the force which would result from a fixed attachment point for the springs. Unfortunately, this prior art example does not provide a counter weight to assist a user in raising or lowering a user body weight during operating conditions.

Another prior art example shows a lift chair that has a base frame, an extendable/retractable chair occupant positioning apparatus attached to the base frame, and a reversible D.C. motor for extension and retraction of the chair occupant positioning apparatus relative to the base frame. A control means is connected to the D.C. motor for actuation of the chair occupant positioning device. A power supply is connected to the control means for motor control. A chair occupant carriage is supported by the base frame. The carriage has a seat and a back portion. Unfortunately, this prior art example requires a power source to utilize the chair, which may not be available, thus rendering the invention useless for its intended purpose. In addition, the large size of this chair impedes its use at kitchen tables or desks, as examples.

Accordingly, a need remains for a combination ergonomic chair and seat pivoting mechanism in order to overcome the above-noted shortcomings. The present invention satisfies such a need by providing an assembly that is convenient and easy to use, is lightweight yet durable in design, and assists a user to transfer their body mass between erect and seated positions. Such an assembly is beneficial for the elderly and those who are physically impaired. The assembly advantageously assists the user to conveniently stand and sit without the assistance of another. The assembly can effectively provide independence and confidence for users who otherwise need help to sit or stand. The assembly is inexpensive, simple to use, and designed for many years of repeated use.

BRIEF SUMMARY OF THE INVENTION

In view of the foregoing background, it is therefore an object of the present invention to provide an assembly for a combination ergonomic chair and seat pivoting mechanism. These and other objects, features, and advantages of the invention are provided by a combination ergonomic chair and seat pivoting mechanism for assisting a user to transfer their body mass between sitting and standing positions:

The assembly includes a chair that has a rigid frame conveniently provided with a seat section pivotally connected to a front end of the frame. Such a seat section is pivotal along a fulcrum axis effectively defined along a front end of the seat section. Such a front end of the seat section advantageously remains contiguously abutted directly with the frame during pivoting motions.

Such a frame includes first and second auxiliary flange members extending rearwardly of the seat section. Such a first flange member is directly coupled to the seat section and anchored to the cable (herein described below). Such a second flange portion is monolithically formed with the frame and effectively spaced from the seat section. The first flange portion is detachably engaged with the second flange portion and advantageously rises above the second flange portion when the user rises to one of the equilibrium positions such that a top surface of the seat section is conveniently biased above a horizontal plane and toward a user.

The assembly further includes a plurality of pulleys selectively connected to spaced portions of the frame, wherein the pulleys are advantageously registered along a single plane. Such pulleys include a first pulley centrally aligned beneath the seat section and a second pulley advantageously disposed subjacent to the first pulley and located rearward thereof. A third pulley is advantageously disposed rearwardly of the second pulley and horizontally aligned parallel to the seat section. A fourth pulley is conveniently positioned above the first, second, and third pulleys and is advantageously connected to a top portion of the frame. A weight member is operably coupled to the pulleys and positioned subjacent to the seat section.

The assembly further includes a cable that has opposed ends tethered directly to the frame and the weight member respectively. Such a cable has a plurality of unique travel paths effectively defined between the pulleys and the weight member such that the user weight is advantageously transferred along the unique paths of the cable.

The assembly further includes a pneumatic piston that has a stationary portion directly coupled to the frame, and further has a linear piston directly coupled to the seat section. Such a stationary portion and linear piston of the pneumatic piston are pivotally coupled to the frame and the seat section respectively. The pneumatic piston and weight member conveniently cooperate in tandem for effectively resisting an operating force directed on the seat section during sitting and standing procedures such that the user weight is gradually transferred between equilibrium and non-equilibrium positions respectively. Such a pneumatic piston includes a flexible conduit and a rotatable valve that has an outlet port in fluid communication with the flexible conduit. Such a flexible conduit is directly coupled to the pneumatic piston such that the pneumatic piston is effectively restricted from telescopically retracting to a fully compressed position based upon a rotational movement of the valve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
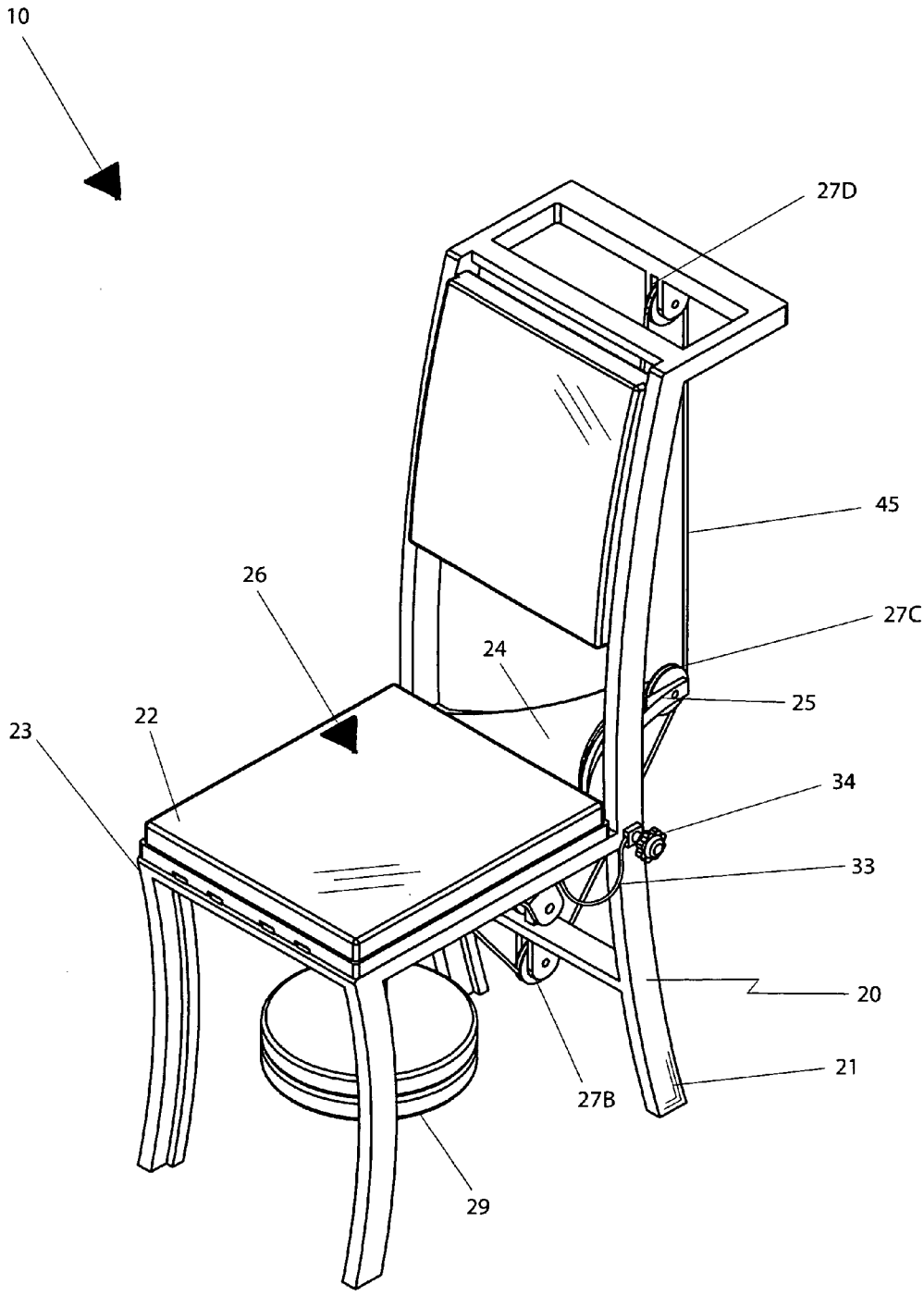
FIG. 1 is a perspective view of a combination ergonomic chair and seat pivoting mechanism, in accordance with the present invention.
Figure 2:
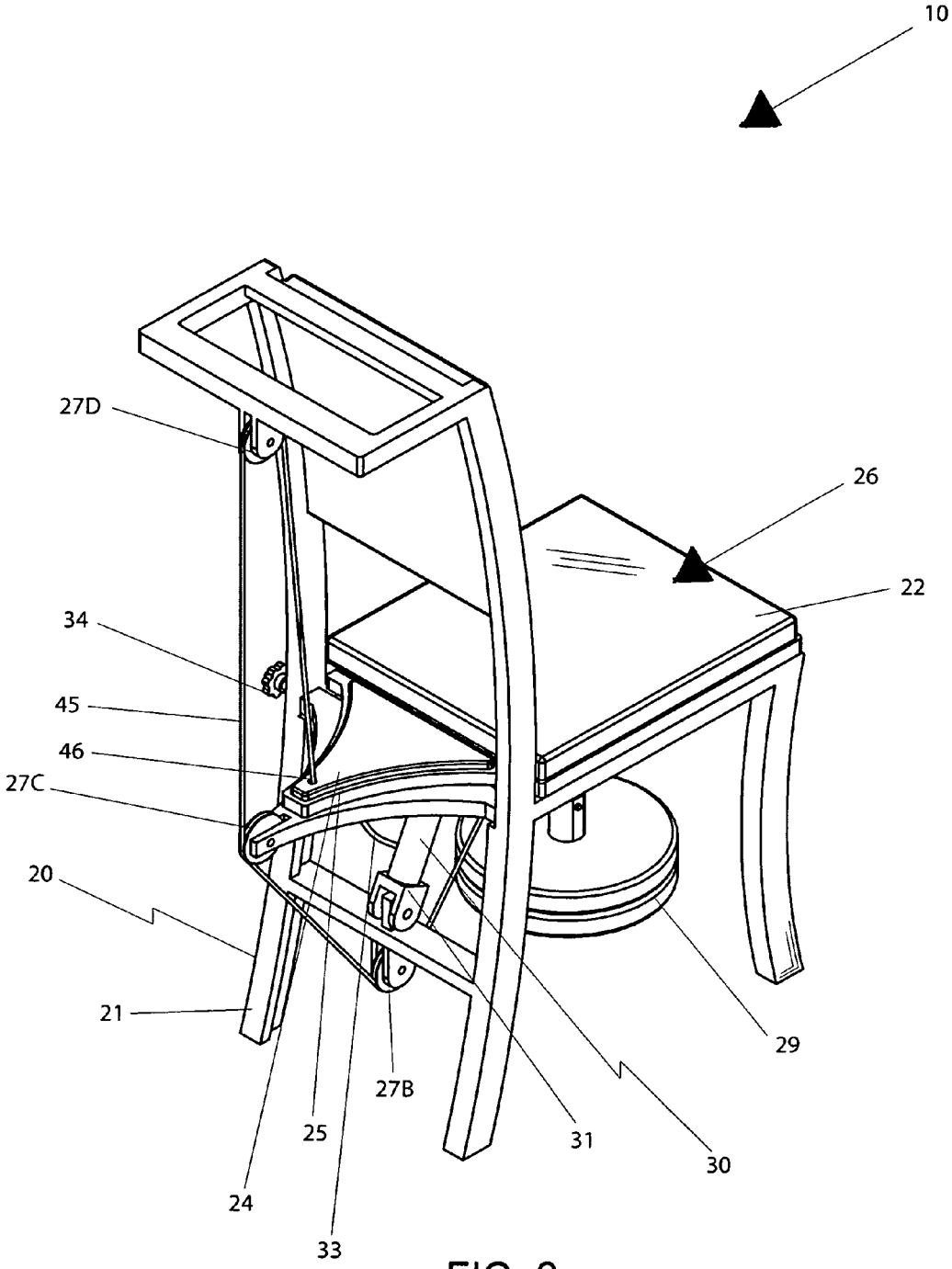
FIG. 2 is a rear perspective view of the assembly shown in FIG. 1.
Figure 3:
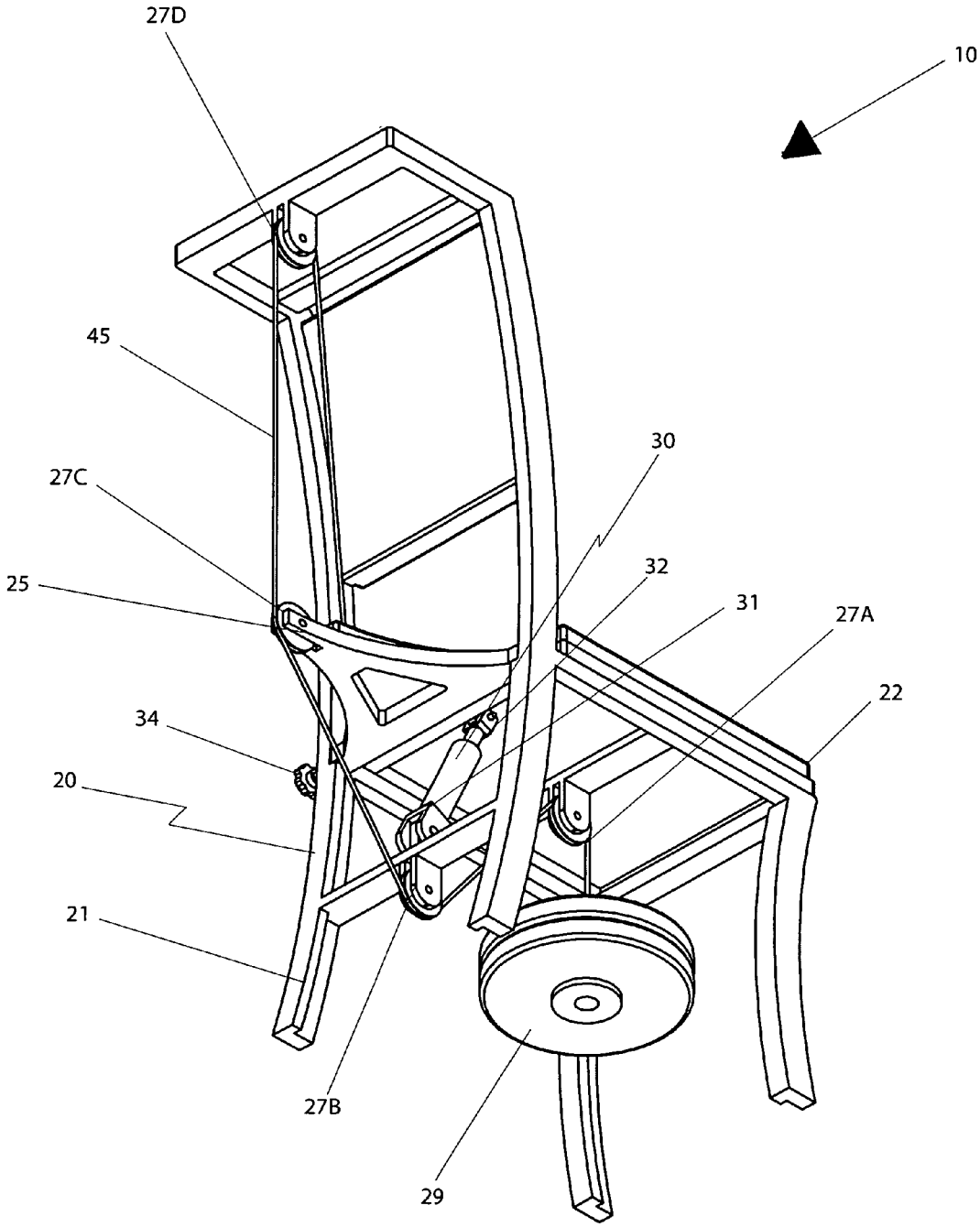
FIG. 3 is a bottom perspective view of the assembly shown in FIG. 1.
Figure 4:
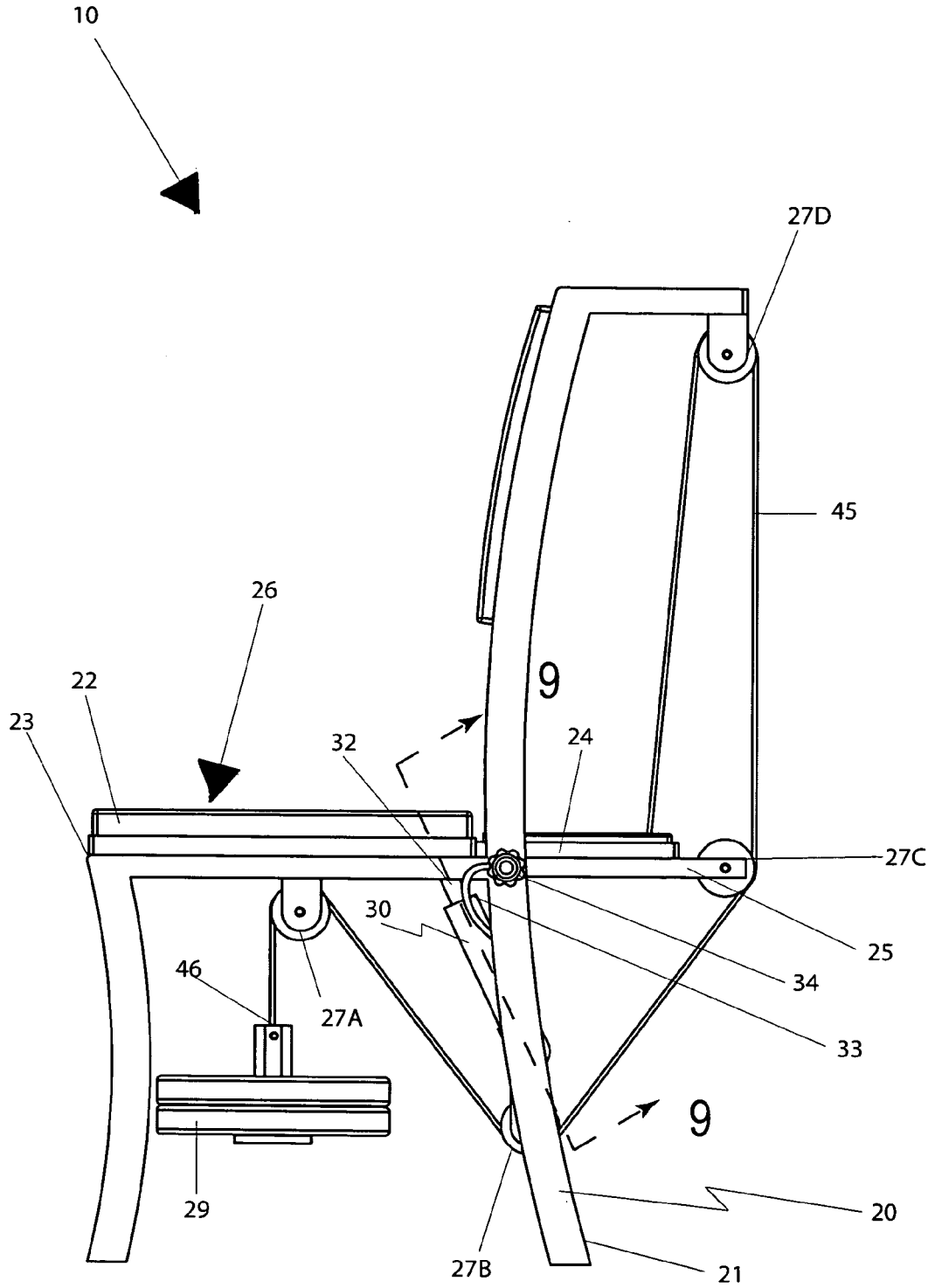
FIG. 4 is a side elevational view of the assembly shown in FIG. 1.
Figure 5:
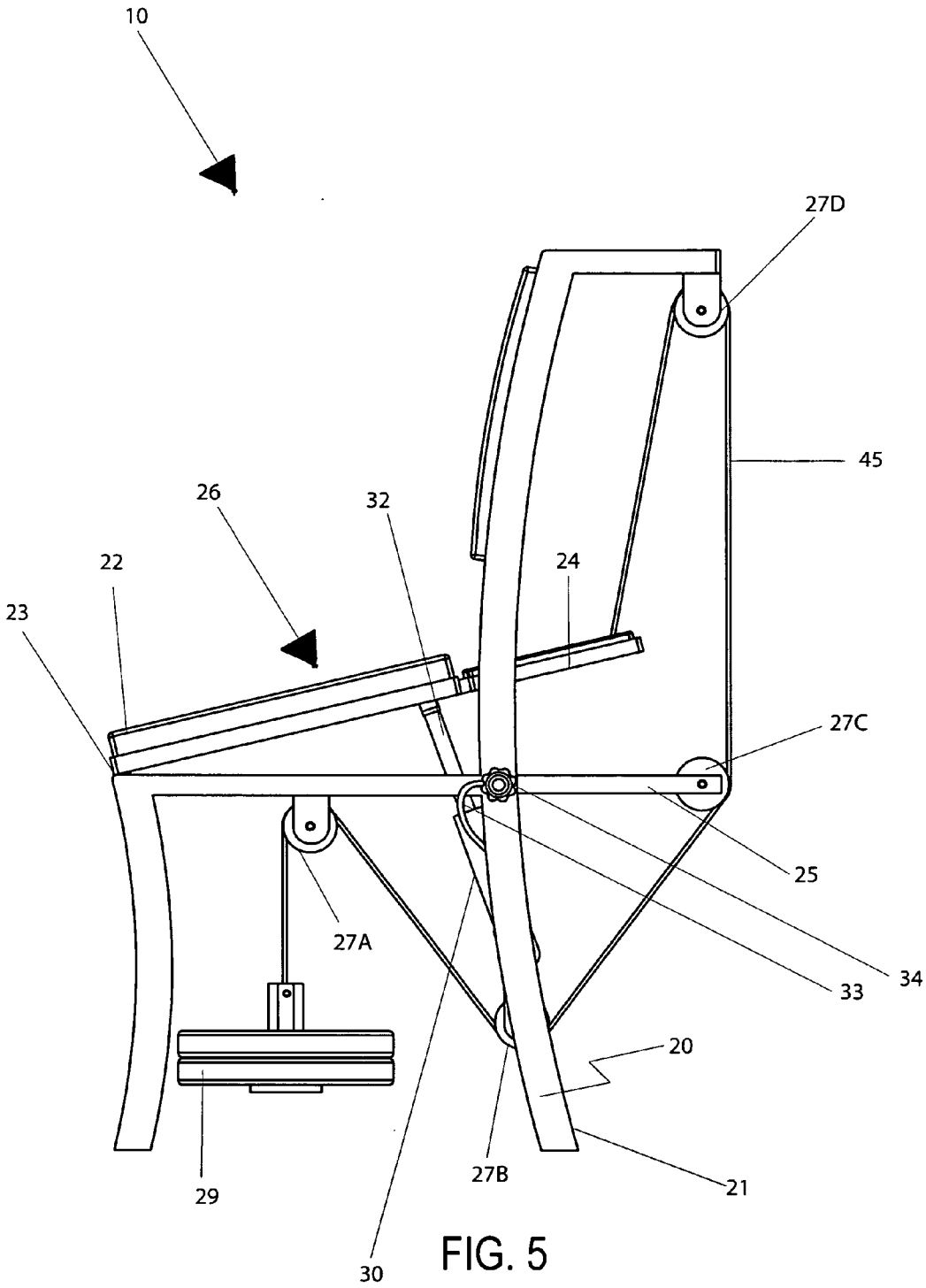
FIG. 5 is a side elevational view of the assembly shown in FIG. 4, showing the seat in a partially raised position.
Figure 6:
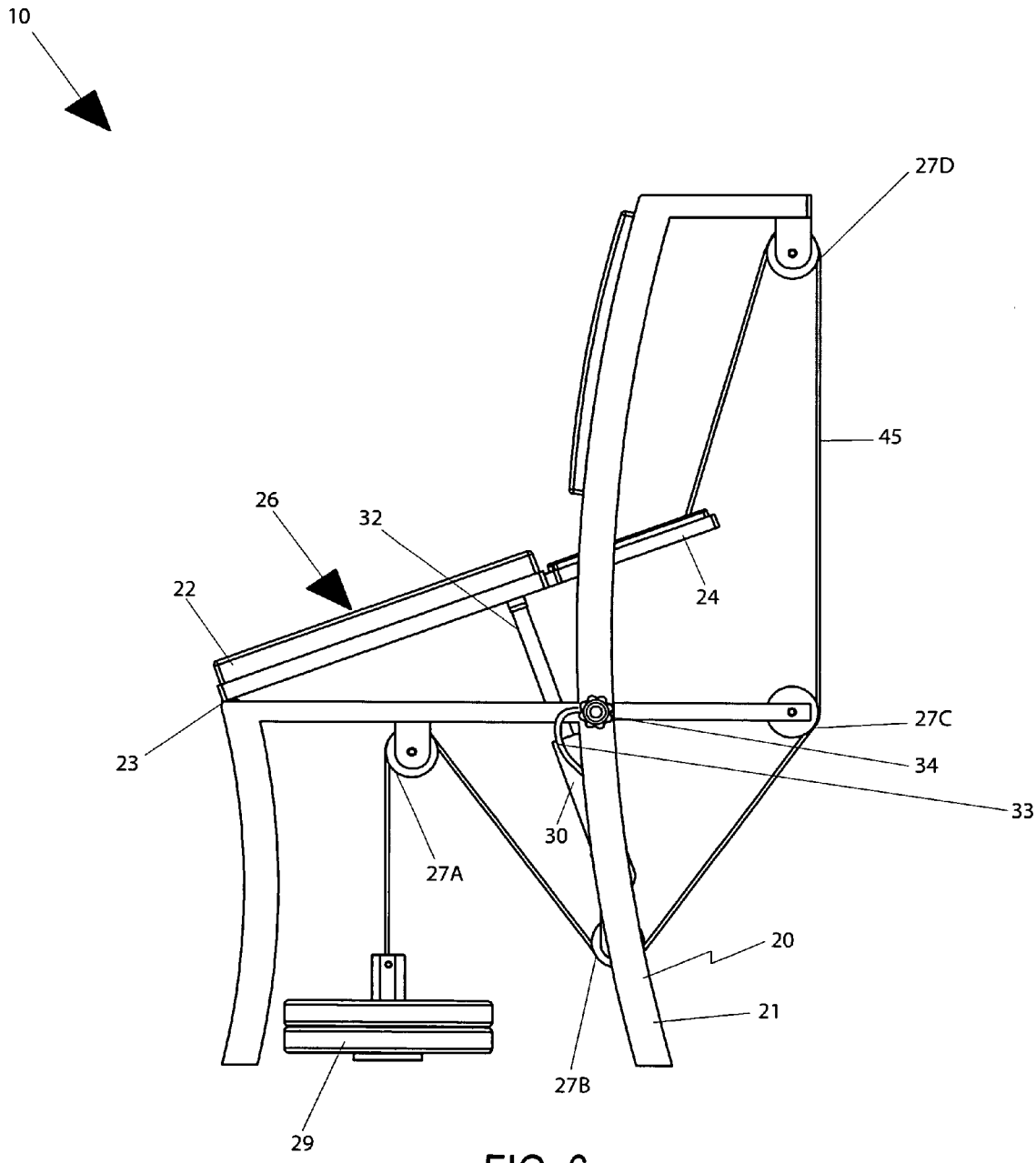
FIG. 6 is a side elevational view of the assembly shown in FIG. 4, showing the seat in a fully raised position.
Figures 7, 8:
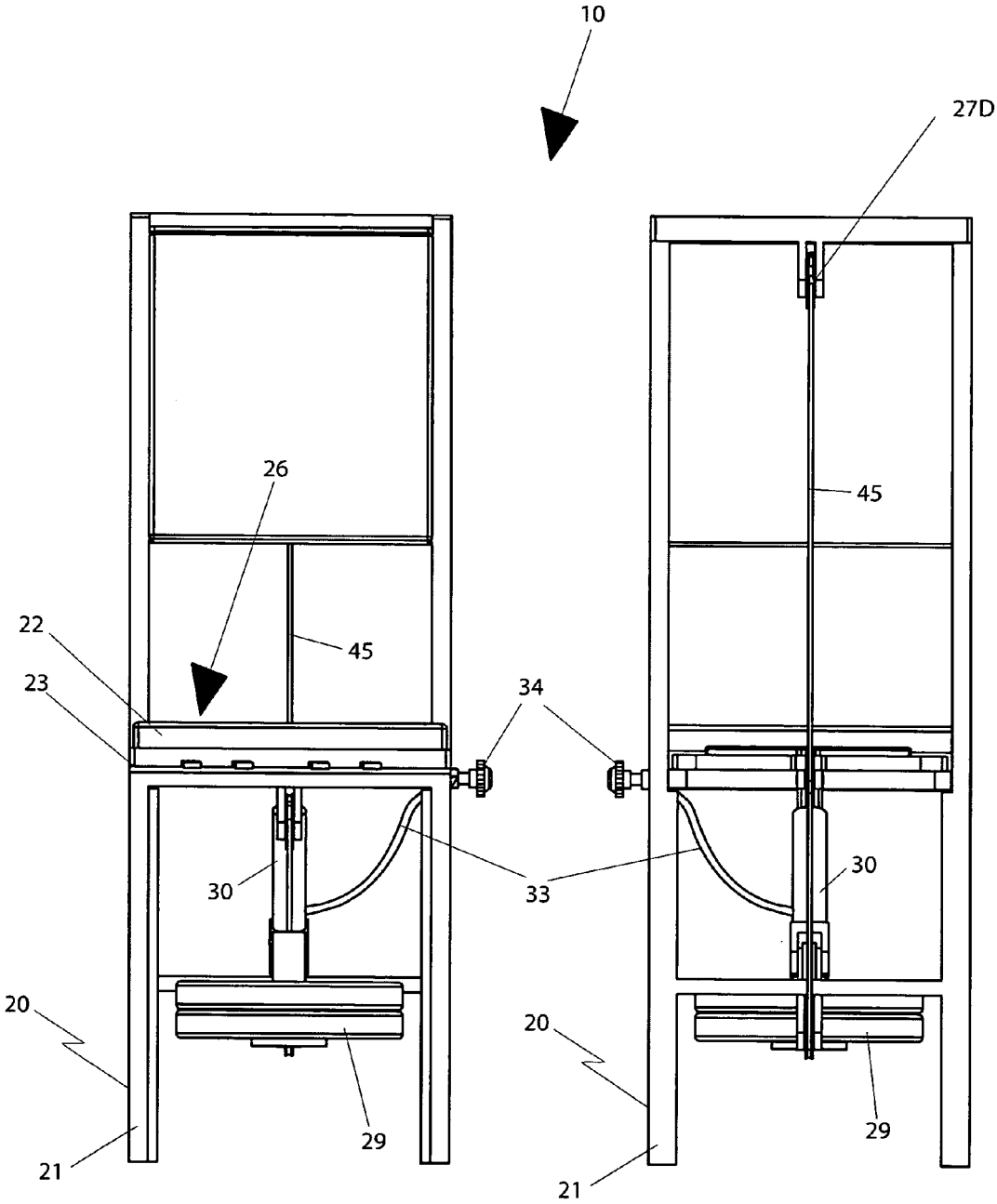
FIG. 7 is a front elevational view of the assembly shown in FIG. 1.
FIG. 8 is a rear elevational view of the assembly shown in FIG. 1.
Figure 9:
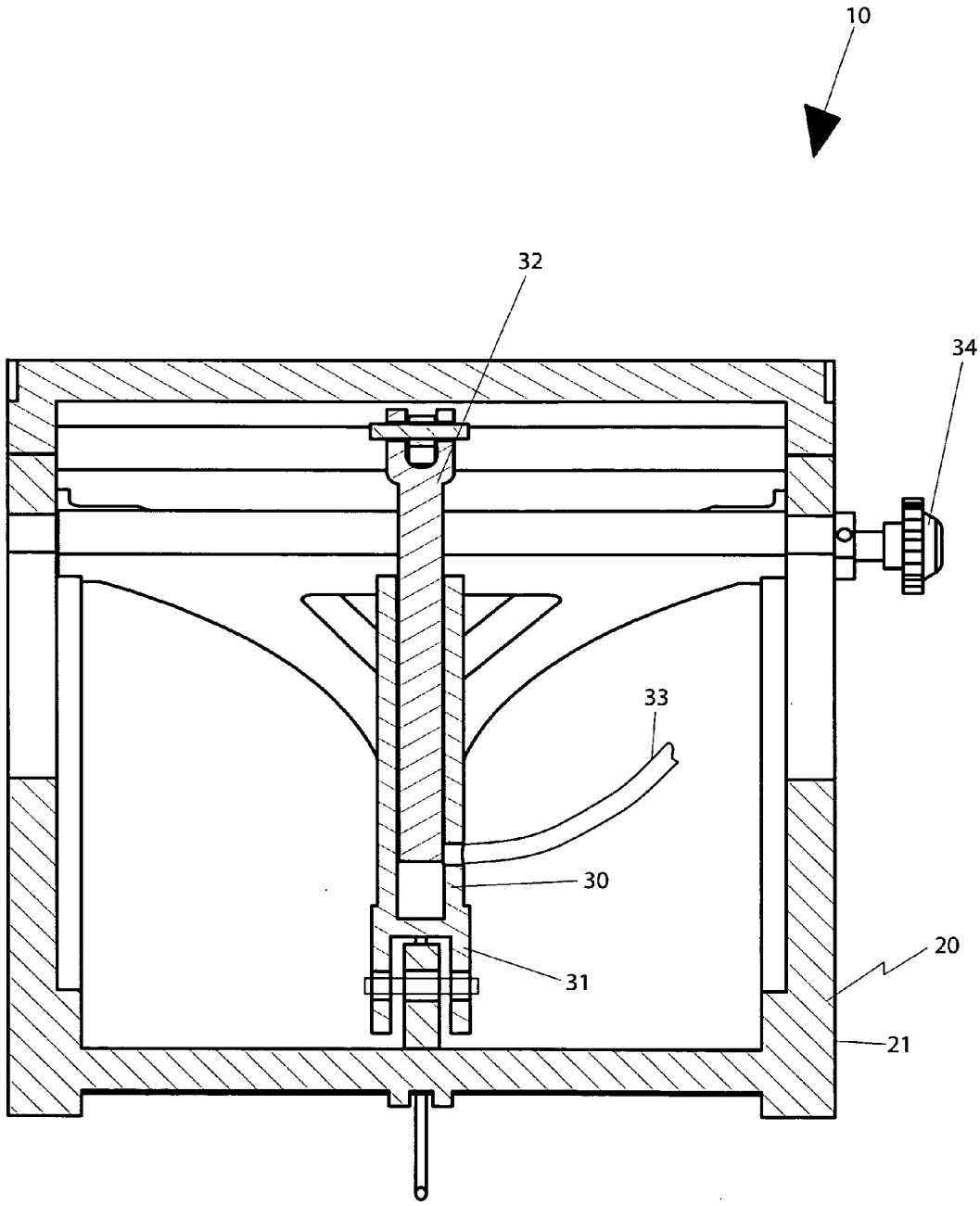
FIG. 9 is a cross sectional view of the assembly shown in FIG. 4, taken along line 9-9.

The assembly of this invention is referred to generally in FIGS. 1-9 by the reference numeral 10 and is intended to provide a combination ergonomic chair and seat pivoting mechanism. It should be understood that the assembly 10 may be used to assist many different types of users and should not be limited in use to assisting only those types of users described herein.

Referring initially to FIGS. 1, 2, 3, 4, 5, 6, 7, 8 and 9, the assembly 10 includes a chair 20 that has a rigid frame 21 provided with a seat section 22 pivotally connected to a front end 23 of the frame 21. Of course, such a seat section 22 can be formed from a variety of suitably comfortable materials, as is obvious to a person of ordinary skill in the art. Such a seat section 22 is pivotal along a fulcrum axis defined along a front end 23 of the seat section 22. Such a front end 23 of the seat section 22 advantageously remains contiguously abutted directly with the frame 21 during pivoting motions, without the use of intervening elements.

Referring to FIGS. 1, 2, 3, 4, 5 and 6, the frame 21 includes first 24 and second 25 auxiliary flange members extending rearwardly of the seat section 22. Such a first flange member 24 is directly coupled to the seat section 22, without the use of intervening elements, and anchored to the cable 45 (herein described below). Such a second flange portion 25 is monolithically formed with the frame 21 and spaced from the seat section 22. The first flange portion 24 is detachably engaged with the second flange portion 25 and advantageously rises above the second flange portion 25 when the user rises to one of the equilibrium positions, which is essential such that a top surface 26 of the seat section 22 is biased above a horizontal plane and toward a user.

Again referring to FIGS. 1 through 6, the assembly 10 further includes a plurality of pulleys 27 selectively connected to spaced portions of the frame 21, wherein the pulleys 27 are advantageously registered along a single plane. Such pulleys 27 include a first pulley 27A centrally aligned beneath the seat section 22 and a second pulley 27B advantageously disposed subjacent to the first pulley 27A and located rearward thereof. A third pulley 27C is advantageously disposed rearwardly of the second pulley 27B and horizontally aligned parallel to the seat section 22. A fourth pulley 27D is positioned above the first, second, and third pulleys 27A, 27B, 27C and is advantageously connected to a top portion 28 of the frame 21. A weight member 29 is operably coupled to the pulleys 27 and positioned subjacent to the seat section 22. Of course, such a weight member 29 can be produced in a variety of shapes and sizes, as is obvious to person of ordinary skill in the art.

Referring to FIGS. 1, 2, 3, 4, 5, 6, 7 and 8, the assembly 10 further includes a cable 45 that has opposed ends 46 tethered directly to the frame 21 and the weight member 29 respectively, without the use of intervening elements. Such a cable 45 has a plurality of unique travel paths defined between the pulleys 27 and the weight member 29, which is critical such that the user weight is advantageously transferred along the unique paths of the cable 45. Of course, such a cable 45 can be formed from a variety of suitable materials, as is obvious to a person of ordinary skill in the art.

Referring to FIGS. 2, 3, 4, 5, 6, 7, 8 and 9, the assembly 10 further includes a pneumatic piston 30 that has a stationary portion 31 directly coupled to the frame 21, without the use of intervening elements, and further has a linear piston 32 directly coupled to the seat section 22, without the use of intervening elements. Such a stationary portion 31 and linear piston 32 of the pneumatic piston 30 are pivotally coupled to the frame 21 and the seat section 22 respectively. The pneumatic piston 30 and weight member 29 cooperate in tandem for resisting an operating force directed on the seat section 22 during sitting and standing procedures, which is crucial such that the user weight is gradually transferred between equilibrium and non-equilibrium positions respectively. An equilibrium position is achieved when a user is sitting or standing respectively. A non-equilibrium position is achieved at any point of motion between the sitting or standing positions respectively.

Referring to FIGS. 1, 4, 5, 6, 7, 8 and 9, the pneumatic piston 30 includes a flexible conduit 33 and a rotatable valve 34 that has an outlet port in fluid communication with the flexible conduit 33. Such a flexible conduit 33 is directly coupled to the pneumatic piston 30, without the use of intervening elements, which is vital such that the pneumatic piston 30 is restricted from telescopically retracting to a fully compressed position based upon a rotational movement of the valve 34. Of course, such a conduit 33 can be formed from a variety of suitably flexible materials, as is obvious to a person of ordinary skill in the art.

The association and cooperation of the pneumatic piston 30 and weight member 29 provides the unexpected benefit of allowing a user to safely and easily sit or stand without assistance from others by using the weight member 29 to offset a user weight during operating conditions, thereby overcoming prior art shortcomings.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combination ergonomic chair and seat pivoting mechanism for assisting a user to transfer their body mass between sitting and standing positions, said combination chair and seat pivoting mechanism comprising:

a chair having a rigid frame provided with a seat section pivotally connected to a front end of said frame;

a plurality of pulleys selectively connected to spaced portions of said frame wherein said pulleys are registered along a single plane;

a weight member operably coupled to said pulleys and positioned subjacent to said seat section;

a cable having opposed ends tethered directly to said frame and said weight member respectively; and a pneumatic piston having a stationary portion directly coupled to said frame and further having a linear piston directly coupled to said seat section, wherein said pneumatic piston and said weight member cooperate in tandem for resisting an operating force directed on said seat section during sitting and standing procedures such that the user weight is gradually transferred between equilibrium and non-equilibrium positions respectively.

2. The combination chair and seat pivoting mechanism of claim 1, wherein said pulleys comprise:

a first pulley centrally aligned beneath said seat section;

a second pulley disposed subjacent to said first pulley and located rearward thereof;

a third pulley disposed rearwardly of said second pulley and horizontally aligned parallel to said seat section; and a fourth pulley positioned above said first, second, and third pulley and connected to a top portion of said frame.

3. The combination chair and seat pivoting mechanism of claim 1, wherein said cable has a plurality of unique travel paths defined between said pulleys and said weight member such that the user weight is transferred along said unique paths of said cable.

4. The combination chair and seat pivoting mechanism of claim 1, wherein said frame comprises:

first and second auxiliary flange members extending rearwardly of said seat section, said first flange member being directly coupled to said seat section and anchored to said cable, said second flange portion being monolithically formed with said frame and spaced from said seat section, wherein said first flange portion is detachably engaged with said second flange portion and rises above said second flange portion when the user rises to one of said equilibrium positions such that a top surface of said seat section is biased above a horizontal plane and toward a user.

5. The combination chair and seat pivoting mechanism of claim 1, wherein said pneumatic piston comprises:

a flexible conduit and a rotatable valve having an outlet port in fluid communication with said flexible conduit, said flexible conduit being directly coupled to said pneumatic piston such that said pneumatic piston is restricted from telescopically retracting to a fully compressed position based upon a rotational movement of said valve.

6. The combination chair and seat pivoting mechanism of claim 1, wherein said stationary portion and said linear portion of said pneumatic piston are pivotally coupled to said frame and said seat section respectively.

7. A combination ergonomic chair and seat pivoting mechanism for assisting a user to transfer their body mass between sitting and standing positions, said combination chair and seat pivoting mechanism comprising:

a chair having a rigid frame provided with a seat section pivotally connected to a front end of said frame, said seat section being pivotal along a fulcrum axis defined along a front end of said seat section;

a plurality of pulleys selectively connected to spaced portions of said frame wherein said pulleys are registered along a single plane;

a weight member operably coupled to said pulleys and positioned subjacent to said seat section;

a cable having opposed ends tethered directly to said frame and said weight member respectively; and a pneumatic piston having a stationary portion directly coupled to said frame and further having a linear piston directly coupled to said seat section, wherein said pneumatic piston and said weight member cooperate in tandem for resisting an operating force directed on said seat section during sitting and standing procedures such that the user weight is gradually transferred between equilibrium and non-equilibrium positions respectively.

8. The combination chair and seat pivoting mechanism of claim 7, wherein said pulleys comprise:

a first pulley centrally aligned beneath said seat section;

a second pulley disposed subjacent to said first pulley and located rearward thereof;

a third pulley disposed rearwardly of said second pulley and horizontally aligned parallel to said seat section; and a fourth pulley positioned above said first, second, and third pulley and connected to a top portion of said frame.

9. The combination chair and seat pivoting mechanism of claim 7, wherein said cable has a plurality of unique travel paths defined between said pulleys and said weight member such that the user weight is transferred along said unique paths of said cable.

10. The combination chair and seat pivoting mechanism of claim 7, wherein said frame comprises:

first and second auxiliary flange members extending rearwardly of said seat section, said first flange member being directly coupled to said seat section and anchored to said cable, said second flange portion being monolithically formed with said frame and spaced from said seat section, wherein said first flange portion is detachably engaged with said second flange portion and rises above said second flange portion when the user rises to one of said equilibrium positions such that a top surface of said seat section is biased above a horizontal plane and toward a user.

11. The combination chair and seat pivoting mechanism of claim 7, wherein said pneumatic piston comprises:

a flexible conduit and a rotatable valve having an outlet port in fluid communication with said flexible conduit, said flexible conduit being directly coupled to said pneumatic piston such that said pneumatic piston is restricted from telescopically retracting to a fully compressed position based upon a rotational movement of said valve.

12. The combination chair and seat pivoting mechanism of claim 7, wherein said stationary portion and said linear portion of said pneumatic piston are pivotally coupled to said frame and said seat section respectively.

13. A combination ergonomic chair and seat pivoting mechanism for assisting a user to transfer their body mass between sitting and standing positions, said combination chair and seat pivoting mechanism comprising:

a chair having a rigid frame provided with a seat section pivotally connected to a front end of said frame, said seat section being pivotal along a fulcrum axis defined along a front end of said seat section, wherein said front end of said seat section remains contiguously abutted directly with said frame during pivoting motions;

a plurality of pulleys selectively connected to spaced portions of said frame wherein said pulleys are registered along a single plane;

a weight member operably coupled to said pulleys and positioned subjacent to said seat section;

a cable having opposed ends tethered directly to said frame and said weight member respectively; and a pneumatic piston having a stationary portion directly coupled to said frame and further having a linear piston directly coupled to said seat section, wherein said pneumatic piston and said weight member cooperate in tandem for resisting an operating force directed on said seat section during sitting and standing procedures such that the user weight is gradually transferred between equilibrium and non-equilibrium positions respectively.

14. The combination chair and seat pivoting mechanism of claim 13, wherein said pulleys comprise:

a first pulley centrally aligned beneath said seat section;

a second pulley disposed subjacent to said first pulley and located rearward thereof;

a third pulley disposed rearwardly of said second pulley and horizontally aligned parallel to said seat section; and a fourth pulley positioned above said first, second, and third pulley and connected to a top portion of said frame.

15. The combination chair and seat pivoting mechanism of claim 13, wherein said cable has a plurality of unique travel paths defined between said pulleys and said weight member such that the user weight is transferred along said unique paths of said cable.

16. The combination chair and seat pivoting mechanism of claim 13, wherein said frame comprises:

first and second auxiliary flange members extending rearwardly of said seat section, said first flange member being directly coupled to said seat section and anchored to said cable, said second flange portion being monolithically formed with said frame and spaced from said seat section, wherein said first flange portion is detachably engaged with said second flange portion and rises above said second flange portion when the user rises to one of said equilibrium positions such that a top surface of said seat section is biased above a horizontal plane and toward a user.

17. The combination chair and seat pivoting mechanism of claim 13, wherein said pneumatic piston comprises:

a flexible conduit and a rotatable valve having an outlet port in fluid communication with said flexible conduit, said flexible conduit being directly coupled to said pneumatic piston such that said pneumatic piston is restricted from telescopically retracting to a fully compressed position based upon a rotational movement of said valve.

18. The combination chair and seat pivoting mechanism of claim 13, wherein said stationary portion and said linear portion of said pneumatic piston are pivotally coupled to said frame and said seat section respectively.

* * * * *